US006935537B2

(12) United States Patent
Tellez

(10) Patent No.: US 6,935,537 B2
(45) Date of Patent: Aug. 30, 2005

(54) SALT DISPENSER FOR BEVERAGE BOTTLE

(76) Inventor: Jose H. Tellez, 2805 McPherson La., Flower Mound, TX (US) 75022

( * ) Notice: Subject to any disclaimer, the term of this patent is extended or adjusted under 35 U.S.C. 154(b) by 0 days.

(21) Appl. No.: 10/746,175

(22) Filed: Dec. 29, 2003

(65) Prior Publication Data

US 2005/0139623 A1 Jun. 30, 2005

(51) Int. Cl.[7] ..... B67D 5/64
(52) U.S. Cl. ..... 222/168; 222/171; 222/172; 222/189.05; 222/548; 222/563; 222/565
(58) Field of Search ..... 222/167, 168, 222/169, 171, 172, 189.03, 189.05, 548, 222/563, 565

(56) References Cited

U.S. PATENT DOCUMENTS

| | | | | |
|---|---|---|---|---|
| 340,564 | A * | 4/1886 | Elliott | 222/465.1 |
| 686,669 | A * | 11/1901 | Cope | 222/168 |
| 1,015,675 | A * | 1/1912 | Gergely | 222/548 |
| 2,443,086 | A | 6/1948 | Turenne | |
| 3,013,698 | A * | 12/1961 | Gordon et al. | 222/158 |
| 3,191,789 | A | 6/1965 | Davidson | |
| 3,245,437 | A * | 4/1966 | Holz | 141/331 |
| 3,469,748 | A * | 9/1969 | Meyers | 222/563 |
| 4,960,246 | A | 10/1990 | Fohrman | |
| 5,746,355 | A * | 5/1998 | Wold | 222/189.02 |
| 6,196,481 | B1 | 3/2001 | Barbagli | |
| 6,265,010 | B1 | 7/2001 | Franco | |
| D446,692 | S | 8/2001 | Bodum | |
| 6,283,339 | B1 * | 9/2001 | Morrow | 222/452 |

* cited by examiner

*Primary Examiner*—Joseph A. Kaufman

(57) ABSTRACT

A salt dispenser for a beverage bottle includes a rotatable member defining a cavity and including a top surface having an aperture formed therein and for receiving salt therethrough to be disposed within the cavity. The rotatable member includes a bottom surface oppositely spaced from the top surface and having a plurality of apertures for allowing salt to pass therethrough. A stationary member is removably attachable to a top opening of a beverage bottle and is slidably receives the rotatable member about a perimeter thereof. The stationary member has a top surface provided with a channel substantially aligned beneath the plurality of apertures for communicating therewith to allow salt to pass downwardly from the cavity to a perimeter of a beverage bottle. The device further includes a plug attached to the top surface of the stationary member for preventing salt from passing beyond the top opening of a beverage bottle.

18 Claims, 2 Drawing Sheets

SALT DISPENSER FOR BEVERAGE BOTTLE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to devices removably attachable to beverage bottles and, more particularly, to a salt dispenser for selectively applying salt to a top perimeter of a beverage bottle opening.

2. Prior Art

Various types of dispensers are known for pepper and other spices. In these dispensers, dispensing is caused by friction between a fixed part and a movable part. The two parts have, on the respective contact surfaces, teeth or sharp-edged corrugations which are intended to grind the pepper grains by friction. In reality, the surfaces are not in contact, but are spaced and have air between them, which determines the final grain size of ground herbs. Rotating the movable part against the fixed part effects dispensing, so that the grains are "seized" between the teeth of the device and finely ground by the latter to the desired size.

This type of dispensing device, however, requires the grains to be of a predetermined and sufficient size and, furthermore, to be sufficiently hard so as to form a compact mass, which is difficult to grind. This type of dispenser device cannot dispense herbs within a very restricted and controlled area. In particular, prior art dispensers cannot dispense herbs such as salt, for example, onto the perimeter of a beverage bottle top opening.

Accordingly, a need remains for a dispenser that selectively applies salt to a top perimeter of a beverage bottle opening.

BRIEF SUMMARY OF THE INVENTION

In view of the foregoing background, it is therefore an object of the present invention to provide a salt dispenser for beverage bottles that is easy to use by consumers. These and other objects, features, and advantages of the invention are provided by a salt-dispensing device, which includes a rotatable member defining a cavity and including a top surface having an aperture formed therein and for receiving salt therethrough to be disposed within the cavity. The rotatable member includes a bottom surface oppositely spaced from the top surface and having a plurality of apertures for allowing salt to pass therethrough. Such a plurality of apertures may be randomly spaced within a perimeter of the rotatable portion. The salt dispenser device may further include a cap removably insertable in the aperture disposed at the top surface of the rotatable member.

The device further includes a stationary member removably attachable to a top opening of a beverage bottle and slidably engageable with the rotatable member. Such a stationary member has a top surface, spaced above an opening of a beverage bottle, and provided with a channel that is substantially aligned beneath the plurality of apertures and for communicating therewith. The stationary member further includes a threaded bottom portion for selectively attaching to a top opening of a beverage bottle. The stationary member further has an outer perimeter provided with a slot extending therearound.

The rotatable member further includes a lower lip portion disposable within the slot and for assisting to guide the rotatable member in a substantially stable path about the stationary member. Advantageously, when the rotatable member is rotated about a perimeter of the stationary member, salt is allowed to pass downwardly from the cavity and onto a perimeter of a beverage bottle.

The device further includes a plug attached to the top surface of the stationary member and extending substantially vertically downward therefrom. Such a plug is preferably formed from latex material. When the stationary member is positioned over a top opening of a beverage bottle, the plug becomes disposed within the top opening and prevents salt from passing therebeyond.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
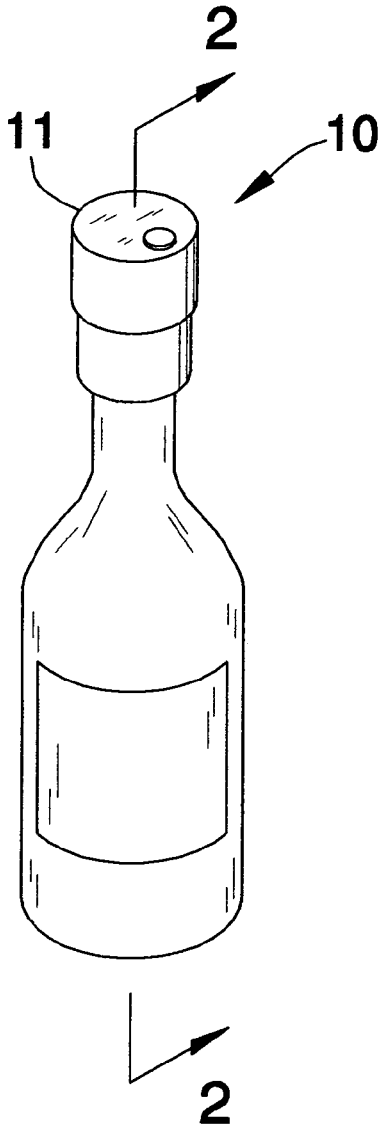
FIG. 1 is a perspective view showing salt-dispensing apparatus attached to a beverage bottle, in accordance with the present invention.
Figure 2:
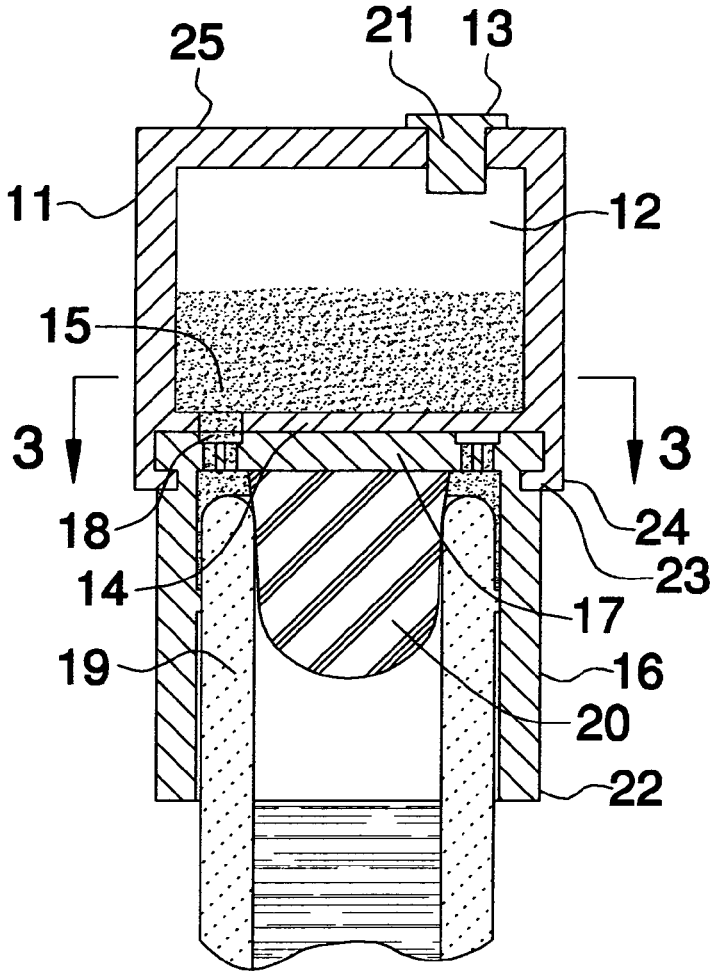
FIG. 2 is an enlarged, partial cross-sectional view taken along line 2—2 in FIG. 1.
Figure 3:
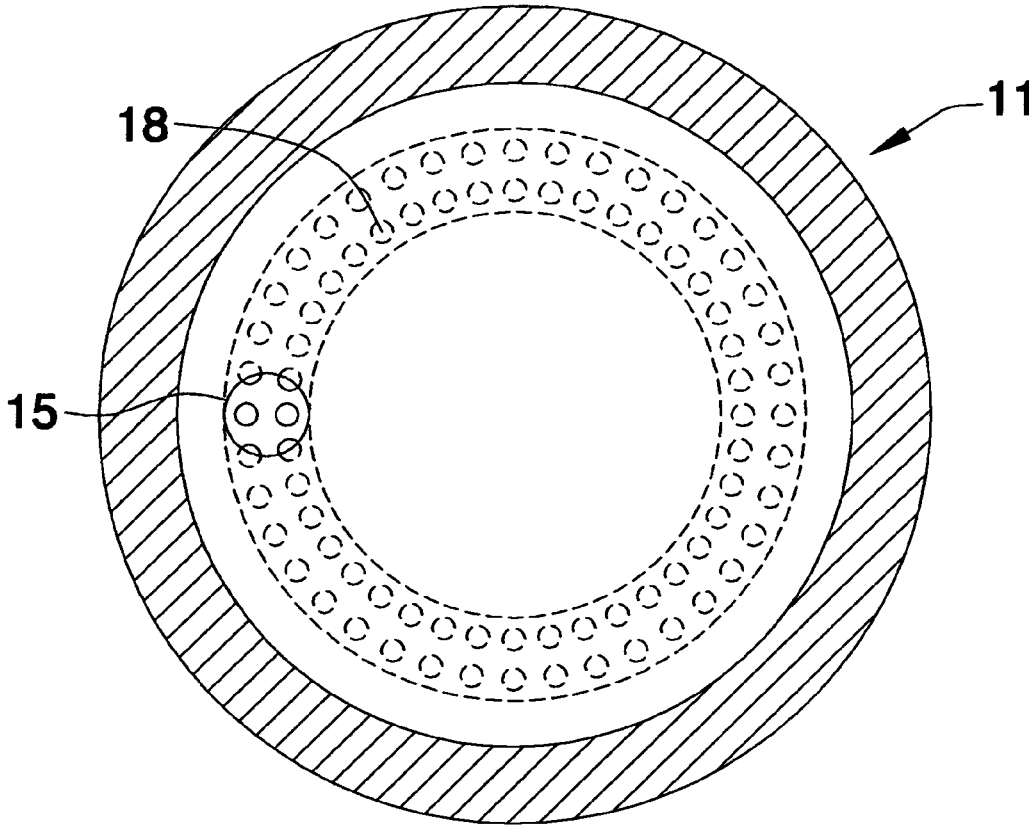
FIG. 3 is an enlarged cross-sectional view taken along line 3—3 in FIG. 2.
Figure 4:
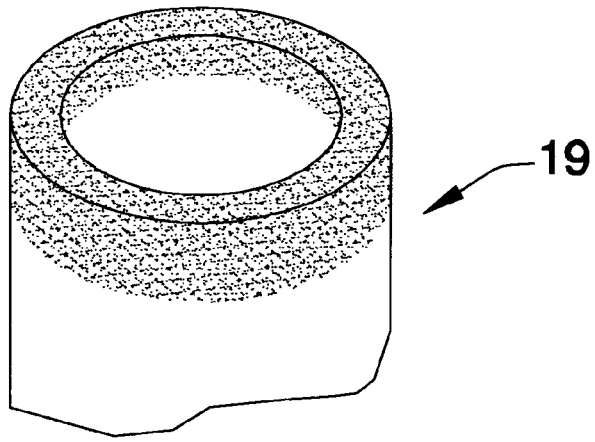
FIG. 4 is a perspective view of a beverage bottle opening covered with salt.

The device of this invention is referred to generally in FIGS. 1 and 2 by the reference numeral 10 and is intended to dispense salt onto a top opening of a beverage bottle 19. It should be understood that the device 10 may be used to dispense salt on many different types of beverage bottles and, therefore, should not be construed as limited to dispensing salt onto only alcoholic beverage bottles.

The apparatus 10 includes a rotatable member 11 defining a cavity 12 and including a top surface 25 having an aperture 13 formed therein and for receiving salt therethrough to be disposed within the cavity 12. The rotatable member 11 includes a bottom surface 14 oppositely spaced from the top surface 25 and having a plurality of apertures 15 for allowing salt to pass therethrough. Such a plurality of apertures 15 may be randomly spaced within a perimeter of the rotatable portion 11. The salt dispenser device may further include a cap 21 removably insertable in the aperture 13 disposed at the top surface 25 of the rotatable member 11.

The device further includes a stationary member 16 removably attachable to a top opening of a beverage bottle and slidably engageable with the rotatable member 11. Such a stationary member 16 has a top surface 17, spaced above an opening of a beverage bottle, and provided with a channel 18 that is substantially aligned beneath the plurality of apertures 13 and for communicating therewith. The stationary member 16 further includes a threaded bottom portion 22 for selectively attaching to a top opening of a beverage bottle 19. The stationary member 16 further has an outer perimeter provided with a slot 23 extending therearound.

The rotatable member 11 further includes a lower lip portion 24 disposable within the slot 23 and for assisting to guide the rotatable member 11 in a substantially stable path about the stationary member 16. Advantageously, when the rotatable member 11 is rotated about a perimeter of the stationary member 16, salt is allowed to pass downwardly from the cavity 12 and onto a perimeter of a beverage bottle 19.

The device further includes a plug 20 attached to the top surface of the stationary member 16 and extending substantially vertically downward therefrom. Such a plug 20 is preferably formed from latex material. When the stationary member 16 is positioned over a top opening of a beverage bottle 19, the plug 20 becomes disposed within the top opening and prevents salt from passing therebeyond.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A salt-dispensing device for a beverage bottle, said device comprising:

a rotatable member defining a cavity and including a top surface having an aperture formed therein and for receiving salt therethrough to be disposed within said cavity, said rotatable member including a bottom surface oppositely spaced from said top surface and having a plurality of apertures for allowing salt to pass therethrough;

a stationary member being removably attachable to a top opening of a beverage bottle and being slidably engaged with said rotatable member and having a top surface provided with a channel substantially aligned beneath said plurality of apertures and for communicating therewith for allowing salt to pass downwardly from said cavity to a perimeter of a beverage bottle when said rotatable member is rotated about a perimeter of said stationary member; and a plug attached to said top surface of said stationary member and extending substantially vertically and downwardly therefrom so that said plug becomes disposed within a top opening of a beverage bottle and for preventing salt from passing therebeyond.

2. The salt-dispensing device of claim 1, further comprising a cap removably insertable in said aperture of said top surface of said rotatable member.

3. The salt-dispensing device of claim 1, wherein said stationary member comprises a threaded bottom portion for selectively attaching to a top opening of a beverage bottle.

4. The salt-dispensing device of claim 1, wherein said stationary member has an outer perimeter provided with a slot extending therearound, said rotatable member includes a lower lip portion disposed within said slot and for assisting to guide said rotatable member in a substantially stable path about said stationary member.

5. The salt-dispensing device of claim 1, wherein said plug is formed from latex material.

6. The salt-dispensing device of claim 1, wherein said plurality of apertures are randomly spaced within a perimeter of said rotatable portion.

7. The salt-dispensing device of claim 1, wherein said top surface of said stationary member is spaced above an opening of a beverage bottle.

8. A salt-dispensing device for a beverage bottle, said device comprising:

a rotatable member defining a cavity and including a top surface having an aperture formed therein and for receiving salt therethrough to be disposed within said cavity, said rotatable member including a bottom surface oppositely spaced from said top surface and having a plurality of apertures for allowing salt to pass therethrough;

a stationary member being removably attachable to a top opening of a beverage bottle and being slidably engaged with said rotatable member and having a top surface provided with a channel substantially aligned beneath said plurality of apertures and for communicating therewith for allowing salt to pass downwardly from said cavity to a perimeter of a beverage bottle when said rotatable member is rotated about a perimeter of said stationary member;

a plug attached to said top surface of said stationary member and extending substantially vertically and downwardly therefrom so that said plug becomes disposed within a top opening of a beverage bottle and for preventing salt from passing therebeyond; and a cap removably insertable in said aperture of said top surface of said rotatable member.

9. The salt-dispensing device of claim 8, wherein said stationary member comprises a threaded bottom portion for selectively attaching to a top opening of a beverage bottle.

10. The salt-dispensing device of claim 8, wherein said stationary member has an outer perimeter provided with a slot extending therearound, said rotatable member includes a lower lip portion disposed within said slot and for assisting to guide said rotatable member in a substantially stable path about said stationary member.

11. The salt-dispensing device of claim 8, wherein said plug is formed from latex material.

12. The salt-dispensing device of claim 8, wherein said plurality of apertures are randomly spaced within a perimeter of said rotatable portion.

13. The salt-dispensing device of claim 8, wherein said top surface of said stationary member is spaced above an opening of a beverage bottle.

14. A salt-dispensing device for a beverage bottle, said device comprising:

a rotatable member defining a cavity and including a top surface having an aperture formed therein and for receiving salt therethrough to be disposed within said cavity, said rotatable member including a bottom surface oppositely spaced from said top surface and having a plurality of apertures for allowing salt to pass therethrough;

a stationary member being removably attachable to a top opening of a beverage bottle and being slidably engaged with said rotatable member and having a top surface provided with a channel substantially aligned beneath said plurality of apertures and for communicating therewith for allowing salt to pass downwardly from said cavity to a perimeter of a beverage bottle when said rotatable member is rotated about a perimeter of said stationary member, said stationary member has an outer perimeter provided with a slot extending therearound, said rotatable member includes a lower lip portion disposed within said slot and for assisting to guide said rotatable member in a substantially stable path about said stationary member;

a plug attached to said top surface of said stationary member and extending substantially vertically and downwardly therefrom so that said plug becomes disposed within a top opening of a beverage bottle and for preventing salt from passing therebeyond; and a cap removably insertable in said aperture of said top surface of said rotatable member.

15. The salt-dispensing device of claim 14, wherein said stationary member comprises a threaded bottom portion for selectively attaching to a top opening of a beverage bottle.

16. The salt-dispensing device of claim 14, wherein said plug is formed from latex material.

17. The salt-dispensing device of claim 14, wherein said plurality of apertures are randomly spaced within a perimeter of said rotatable portion.

18. The salt-dispensing device of claim 14, wherein said top surface of said stationary member is spaced above an opening of a beverage bottle.

* * * * *